US011772396B2

(12) United States Patent
Takei et al.

(10) Patent No.: US 11,772,396 B2
(45) Date of Patent: Oct. 3, 2023

(54) RECORDING DEVICE WITH AIR FLOW PATH FOR COOLING A RECORDING UNIT

(71) Applicant: SEIKO EPSON CORPORATION, Tokyo (JP)

(72) Inventors: Atsushi Takei, Yokohama (JP); Junya Hayakawa, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/645,677

(22) Filed: Dec. 22, 2021

(65) Prior Publication Data

US 2022/0203735 A1 Jun. 30, 2022

(30) Foreign Application Priority Data

Dec. 25, 2020 (JP) ..... 2020-216981

(51) Int. Cl.

| | |
|---|---|
| ***B41J 29/377*** | (2006.01) |
| ***B41J 13/10*** | (2006.01) |
| ***B65H 31/20*** | (2006.01) |
| ***B41J 2/335*** | (2006.01) |
| ***B41J 2/14*** | (2006.01) |
| *B65H 5/06* | (2006.01) |
| *B41J 3/44* | (2006.01) |
| *B41J 11/00* | (2006.01) |

(52) U.S. Cl.

CPC ..... *B41J 29/377* (2013.01); *B41J 2/1408* (2013.01); *B41J 2/3358* (2013.01); *B41J 13/106* (2013.01); *B65H 31/20* (2013.01); *B41J 3/445* (2013.01); *B41J 11/0022* (2021.01); *B41J 2202/08* (2013.01); *B65H 5/062* (2013.01)

(58) Field of Classification Search

CPC ..... B41J 29/377; B41J 2/1408; B41J 2/3358; B41J 13/106; B41J 3/445; B41J 11/0022; B41J 2202/08; B65H 31/20; B65H 5/062

See application file for complete search history.

(56) References Cited

U.S. PATENT DOCUMENTS

2011/0026963 A1* 2/2011 Kondo ..... G03G 21/1619 399/92
2020/0047512 A1* 2/2020 Kida ..... B41J 29/377

FOREIGN PATENT DOCUMENTS

JP 2020-026073 A 2/2020

* cited by examiner

*Primary Examiner* — Henok D Legesse
(74) *Attorney, Agent, or Firm* — WORKMAN NYDEGGER

(57) ABSTRACT

A recording device includes a recording unit configured to perform recording on a medium, and a discharge tray located above the recording unit in a height direction of the recording device and configured to support the medium discharged after recording is performed thereon, and a flow path of air for cooling a cooling target is formed along a lower surface of the discharge tray. The recording unit is an example of the cooling target.

12 Claims, 7 Drawing Sheets

RECORDING DEVICE WITH AIR FLOW PATH FOR COOLING A RECORDING UNIT

The present application is based on, and claims priority from JP Application Serial Number 2020-216981, filed Dec. 25, 2020, the disclosure of which is hereby incorporated by reference herein in its entirety.

BACKGROUND

1. Technical Field

The invention relates to a recording device that performs recording on a medium.

2. Related Art

In a recording device represented by a printer, there is a case in which a cooling unit for cooling a target that needs to be cooled is provided. A recording device described in JP-A-2020-26073 is provided with a cooling unit for cooling a tank that stores ink. In the recording device described in JP-A-2020-26073, an intake port for introducing outside air and a discharge port for discharging air from inside the device are provided on the same side surface of the device. Note that the intake port and the discharge port are located in the central region in the height direction of the device, and the intake port is located near the upper portion of the discharge port. Then, when the discharge fan is driven, the air flowing in from the intake port travels toward a recording head in the horizontal direction, and when the air hits the recording head, it travels downward with the recording head as a wall. Then, the air is U-turned to the discharge port and travels toward the discharge port along the horizontal direction.

In the recording device described in JP-A-2020-26073, it is necessary to form an air flow path that crosses the device in the horizontal direction. Therefore, a large component cannot be arranged at a position where the air flow path is formed, so that not only the degree of freedom of the design may be reduced, but also the device may become larger in the height direction as a result.

SUMMARY

In order to solve the above-described issue, a recording device according to the present disclosure includes a recording unit configured to perform recording on a medium, and a discharge tray located above the recording unit in a height direction of the recording device and configured to support the medium discharged after recording is performed thereon, and a flow path of air for cooling the recording unit is formed along a lower surface of the discharge tray.

DESCRIPTION OF EXEMPLARY EMBODIMENTS

Figure 1:
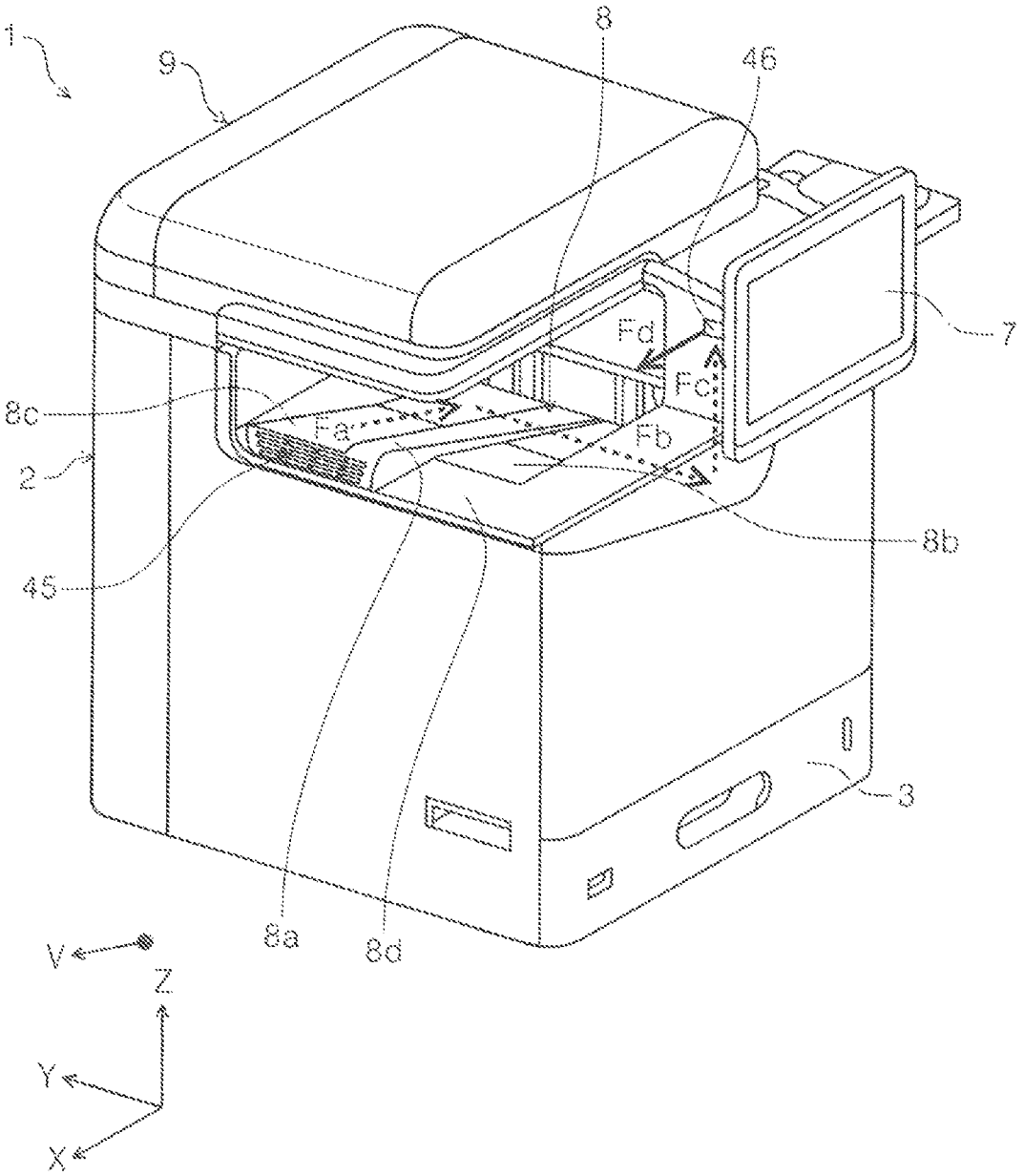
FIG. 1 is an external perspective view of a printer.

Hereinafter, the present disclosure will be schematically described.

A recording device according to a first aspect includes a recording unit configured to perform recording on a medium, and a discharge tray located above the recording unit in a height direction of the recording device and configured to support the medium discharged after recording is performed thereon, and a flow path of air for cooling the recording unit is formed along a lower surface of the discharge tray.

According to the present aspect, the flow path of air for cooling the recording unit is formed along the lower surface of the discharge tray, that is, the flow path is formed by using the lower surface of the discharge tray. Therefore, it is not necessary to separately secure a space for the air to flow in the horizontal direction inside the device. As a result, the degree of freedom of the design is improved, and the size of the device in the height direction can also be suppressed.

According to a second aspect, an intake port is included at a downstream end of the discharge tray in a medium discharge direction, the recording unit is located below the discharge tray in the height direction and the flow path extends from the intake port to the recording unit along the lower surface of the discharge tray, in the first aspect.

According to the present aspect, in a configuration in which the intake port is included at the downstream end of the discharge tray in the medium discharge direction, the recording unit is located upstream of the discharge tray in the medium discharge direction below the discharge tray, and the flow path extends from the intake port to the recording unit along the lower surface of the discharge tray, the effect of the first aspect described above can be obtained.

According to a third aspect, the discharge tray includes a protruding portion that is formed along the medium discharge direction and protrudes upward and at least a portion of the intake port is formed in the protruding portion, in the second aspect.

According to the present aspect, since the protruding portion configured to protrude the medium upward is formed along the medium discharge direction, the medium supported by the discharge tray bends in the width direction that intersects with the medium discharge direction, and the rigidity along the medium discharge direction is improved. As a result, the alignability of the medium on the discharge tray is improved.

Further, since at least a portion of the intake port is formed in the protruding portion, the size of the discharge tray associated with the provision of the intake port can be suppressed, and thus the size of the device can be suppressed.

According to a fourth aspect, the discharge tray includes a first portion extending from the protruding portion toward one end in a width direction that intersects with the medium discharge direction, and a second portion that extends from the protruding portion toward the other end in the width direction, and the intake port extends toward the one end in the width direction through the first portion, in the third aspect.

According to the present aspect, since the intake port extends toward the one end in the width direction through the first portion, the intake port can be formed in a wider range, and thus the intake efficiency can be improved.

According to a fifth aspect, air that passed through the recording unit is discharged from a discharge port located above the discharge tray, in any one of the first to fourth aspects.

When the discharge port is located below the intake port, hot air discharged from the discharge port may be introduced from the intake port. However, according to the present aspect, since the air that has passed through the recording unit is discharged from the discharge port located above the discharge tray, the above-described problem can be avoided.

According to a sixth aspect, the intake port and the discharge port are provided at positions spaced apart from each other in a horizontal direction, in the fifth aspect.

According to the present aspect, since the intake port and the discharge port are provided at positions spaced apart from each other in the horizontal direction, the possibility that the hot air discharged from the discharge port is introduced from the intake port can be further suppressed.

According to a seventh aspect, the recording unit extends along a width direction that intersects with the medium discharge direction and includes a heat dissipation member extending along the width direction, and air that reached the recording unit through the flow path is introduced into the recording unit and flows in the width direction along the heat dissipation member, in any one of the first to sixth aspects.

According to the present aspect, in a configuration extended along the width direction that intersects with the medium discharge direction, the air that has reached the recording unit through the flow path is introduced into the recording unit and flows in the medium width direction along the heat dissipation member, so the efficiency of heat dissipation from the heat dissipation member can be improved in the recording unit.

According to an eighth aspect, the recording unit includes an opening that is configured to introduce the air that reached the recording unit through the flow path into the recording unit is included, and at least a portion of the opening overlaps the intake port in a direction along the discharge tray, in the seventh aspect.

According to the present aspect, at least a portion of the opening overlaps the intake port in the direction along the discharge tray, so the air introduced from the intake port is directed straight toward the opening along the lower surface of the discharge tray, and thus the intake efficiency of the air from the opening is improved.

According to a ninth aspect, the recording unit is movably provided toward and away from a medium transport path formed at a position opposing the recording unit by moving along the lower surface of the discharge tray, in any one of the first to eighth aspects.

The recording unit may need to be movably provided toward and away from the medium transport path for maintenance. According to the present aspect, since the recording unit moves toward and away from the medium transport path by moving along the lower surface of the discharge tray, a space for the recording unit to advance and retreat can be suppressed, and thus the size of the device can be suppressed.

Further, the recording unit can be prevented from separating from the flow path, and thus, regardless of the position of the recording unit, the recording unit can be efficiently cooled.

According to a tenth aspect, a liquid storage unit configured to store liquid to be discharged from the recording unit, the recording unit performs recording on the medium by discharging the liquid from a liquid discharging head configured to discharge the liquid, and the flow path is located between the liquid storage unit and the discharge tray in the height direction, in the ninth aspect.

According to a tenth aspect, the liquid storage unit may overlap at least a portion of the recording unit in a horizontal direction.

According to the present aspect, since the flow path faces the space in which the liquid storage unit is provided, a portion of the space can be used as the flow path, and thus the size of the device can be suppressed.

According to an eleventh aspect, the liquid storage unit is detachable and is brought into a mounted state by moving in a direction of retracting from the flow path, in the tenth aspect.

According to the present aspect, since the liquid storage unit is configured to be detachable, and to be brought into the mounted state by moving in the direction of retracting from the flow path, a space for attaching and detaching the liquid storage unit is formed at a position facing the flow path in the liquid storage unit. Therefore, when the liquid storage unit is in the mounted state, a region facing the flow path in a space where the liquid storage unit is provided increases. As a result, the flow path can be enlarged, and thus the cooling target can be cooled more efficiently.

Hereinafter, the present disclosure will be specifically described.

Hereinafter, an inkjet printer 1 that performs recording by discharging ink, which is an example of a liquid, on a medium represented by recording paper is described as an example of a recording device. Hereinafter, the inkjet printer 1 is abbreviated as the printer 1.

Note that an X-Y-Z coordinate system illustrated in each figures is an orthogonal coordinate system, and a Y-axis direction is a direction that intersects with a transport direction of the medium, that is, is a medium width direction, and also is a device depth direction. Of the Y-axis direction, a +Y direction is the direction from a front surface of the device toward a back surface of the device, and a −Y direction is the direction from the back surface of the device toward the front surface of the device.

An X-axis direction is a device width direction, and a +X direction is on the left side and a −X direction is on the right side when viewed from the operator of the printer 1. A Z-axis direction is the vertical direction, that is, a device height direction, and a +Z direction is the upward direction and a −Z direction is the downward direction.

In the following, the direction in which the medium is sent may be referred to as "downstream", and an opposite direction thereof may be referred to as "upstream". Further, in each figure, a medium transport path is illustrated by a dashed line. In the printer 1, the medium is transported through the medium transport path illustrated by the dashed line.

Further, an F-axis direction is the medium transport direction between a line head 51 and a transport belt 13 which will be described later, that is, in a recording region, and a +F direction is downstream in the transport direction, and the opposite −F direction is upstream in the transport direction. Furthermore, a V-axis direction is a movement direction of a head unit 50 which will be described later, a +V direction in the V-axis direction is a direction in which the head unit 50 moves away from the transport belt 13, and a −V direction is a direction in which the head unit 50 approaches the transport belt 13.

Further, in the present embodiment, the +V direction is referred to as a medium discharge direction. In the present embodiment, the V-axis direction is also a direction along the inclination of a discharge tray 8, which will be described later.

As illustrated in FIG. 1, the printer 1 is configured as a composite machine provided with a scanner unit 9, which is an example of an image reading device, on an upper portion of a device main body 2 that performs recording on a medium which is represented by the recording paper.

An operating panel 7 is arranged on the front surface side of the device main body 2, and at the upper portion of the device main body 2, a portion of the front surface and a portion of the left side surface are configured to be opened and formed as a region for removing the medium on which recording is performed and discharged. A reference numeral 8 is the discharge tray that supports the discharged medium.

In the discharge tray 8, a protruding portion 8*a* protruding upward along the V-axis direction, that is, the medium discharge direction is formed. The protruding portion 8*a* is provided at a substantially central portion of the discharge tray 8 in the Y-axis direction, that is, in the medium width direction. Due to such a protruding portion 8*a*, the medium supported by the discharge tray 8 bends in the medium width direction. As a result, the rigidity along the medium discharge direction is improved, curling of the medium on the discharge tray 8 is suppressed, and alignability is improved.

In the −V direction, that is, upstream in the medium discharge direction in the discharge tray 8, a support surface 8*b* that supports the medium is formed on both sides of the protruding portion 8*a* in the medium width direction.

Further, downstream in the +V direction, that is, in the medium discharge direction in the discharge tray 8, a first portion 8*c* extends from the protruding portion 8*a* in the +Y direction, and a second portion 8*d* extends from the protruding portion 8*a* in the −Y direction. The first portion 8*c* forms a surface higher than the second portion 8*d* and extends in an inclined shape along the V-axis direction. The second portion 8*d* is a surface parallel to the horizontal direction in the present embodiment. By forming such a second portion 8*d*, a downstream end of the discharged medium in the medium discharge direction is lifted from the second portion 8*d*, and the take-out property when taking out the medium becomes easy.

An intake port 45 for introducing outside air is formed at a downstream end of the discharge tray 8 in the medium discharge direction. Further, behind the operation panel 7, a discharge port 46 for discharging air from the inside of the device is formed. The printer 1 can introduce air into the device from the intake port 45, and the introduced air passes through flow paths Fa, Fb, and Fc and is discharged as illustrated by an arrow Fd. As described above, the flow path of air for cooling the head unit 50, which will be described later, is formed, but this will be described later again.

Figure 2:
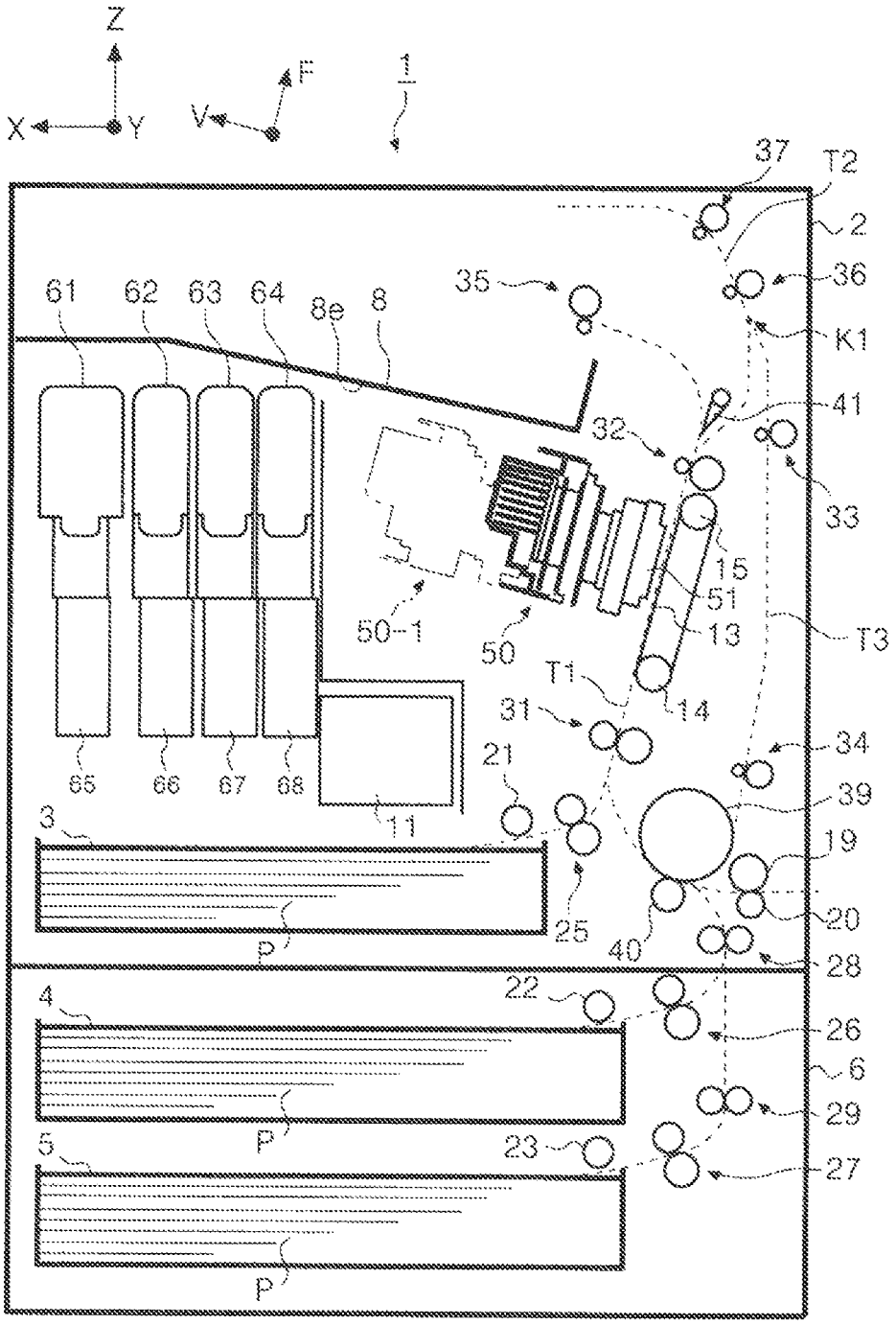
FIG. 2 is a diagram illustrating a medium transport path of the printer.

Next, the medium transport path in the printer 1 will be described with reference to FIG. 2. The printer 1 is configured so that an expansion unit 6 can be coupled to the lower portion of the device main body 2, and FIG. 2 illustrates a state in which the expansion unit 6 is coupled.

The device main body 2 includes a first medium cassette 3 that accommodates the medium at a lower portion thereof, and when the expansion unit 6 is coupled, a second medium cassette 4 and a third medium cassette 5 are further provided below the first medium cassette 3.

Each medium cassette is provided with a pick roller that feeds the accommodated medium in the −X direction. Pick rollers 21, 22, and 23 are pick rollers provided for the first medium cassette 3, the second medium cassette 4, and the third medium cassette 5, respectively. Further, each medium cassette is provided with a feeding roller pair that feeds the medium sent out in the −X direction in an oblique upward direction. Feeding roller pairs 25, 26, and 27 are feeding roller pairs provided for the first medium cassette 3, the second medium cassette 4, and the third medium cassette 5, respectively.

In the following, unless otherwise specified, the "roller pair" is constituted by a drive roller driven by a motor (not illustrated) and a driven roller that is driven to rotate in contact with the drive roller.

The medium fed from the third medium cassette 5 is sent to an inversion roller 39 by transport roller pairs 29 and 28. The medium fed from the second medium cassette 4 is sent to the inversion roller 39 by the transport roller pair 28. The medium is nipped by the inversion roller 39 and a driven roller 40 and fed to a transport roller pair 31.

The medium fed from the first medium cassette 3 is sent to the transport roller pair 31 without passing through the inversion roller 39.

A supply roller 19 and a separation roller 20 provided in the vicinity of the inversion roller 39 are a pair of rollers that feed the medium from a supply tray, which is not illustrated in FIG. 1.

The medium that receives the feeding force from the transport roller pair 31 is fed between the line head 51 which is an example of the recording head and the transport belt 13, that is, to a recording position opposing the line head 51. In the following, the transport path from the transport roller pair 31 to a transport roller pair 32 is referred to as a recording time transport path T1.

The line head 51 constitutes the head unit 50. The line head 51 discharges ink, which is an example of a liquid, onto the surface of the medium to perform recording. The line head 51 is an ink discharging head configured such that a nozzle that discharges ink covers the entire area in the medium width direction, and is configured as an ink discharging head capable of recording across the entire medium width without moving in the medium width direction. However, the ink discharging head is not limited thereto, and may be a type that is mounted on a carriage and discharges ink while moving in the medium width direction.

The head unit 50 is provided so as to advance and retract with respect to the recording time transport path T1, and is displaceably provided between the recording position illustrated by a solid line in FIG. 2 and a retracted position at which the head unit 50 is retracted most from the transport belt 13 as illustrated by a two-dot chain line and a reference numeral 50-1 in FIG. 2. When the head unit 50 is at the retracted position, maintenance of the line head 51 is performed by a maintenance unit (not illustrated). In the present embodiment, the displacement direction of the head unit 50 is the V-axis direction along the inclination of the discharge tray 8. The head unit 50 is located upstream in the medium discharge direction below the discharge tray 8, and is displaced along a lower surface 8*e* of the discharge tray 8.

Reference numerals 61, 62, 63, and 64 are ink storage units as liquid storage units. The ink discharged from the line head 51 is supplied from each ink storage unit to the line head 51 via a tube (not illustrated). Each ink storage unit is provided so as to be detachable.

Further, a reference numeral 11 is a waste liquid storage unit that stores ink as waste liquid that is discharged from the line head 51 toward a flushing cap (not illustrated) for maintenance.

The transport belt 13 is an endless belt that is hung around a pulley 14 and a pulley 15, and rotates when at least one of the pulley 14 and the pulley 15 is driven by a motor (not illustrated). The medium is suctioned by a belt surface of the transport belt 13 and is transported in a position opposing the line head 51. As the suction of the medium to the transport belt 13, a known suction method such as an air suction method or an electrostatic suction method can be adopted.

Here, the recording time transport path T1 that passes through a position opposing the line head 51 is configured to form an angle with respect to the horizontal direction and the vertical direction, and transports the medium upward. This upward transport direction is a direction that includes the −X direction component and the +Z direction component in FIG. 1, and the horizontal dimension of the printer 1 can be suppressed by such a configuration.

Note that in the present embodiment, the recording time transport path T1 is set to have an inclination angle in a range of 65° to 85°, and more specifically, is set to have an inclination angle of approximately 75°, with respect to the horizontal direction.

The medium in which recording has been performed on a first surface by the line head 51 is fed further upward by the transport roller pair 32 located downstream of the transport belt 13.

A flap 41 is provided downstream of the transport roller pair 32, and the flap 41 switches the transport direction of the medium. When the medium is discharged as it is, the transport path of the medium is switched by the flap 41 toward a transport roller pair 35 above, and the medium is discharged toward the discharge tray 8 by the transport roller pair 35.

When the recording is further performed on a second surface in addition to the first surface of the medium, the transport direction of the medium is directed to a branching position K1 by the flap 41. Then, the medium passes through the branching position K1 and enters a switchback path T2. In the present embodiment, the switchback path T2 is a medium transport path above the branching position K1. The switchback path T2 is provided with transport roller pairs 36 and 37. The medium that has entered the switchback path T2 is transported in the upward direction by the transport roller pairs 36 and 37, and when the lower edge of the medium passes the branching position K1, the rotation direction of the transport roller pairs 36 and 37 is switched, so that the medium is transported in the downward direction.

An inversion path T3 is coupled to the switchback path T2. In the present embodiment, the inversion path T3 is a medium transport path from the branching position K1 to the inversion roller 39 through transport roller pairs 33 and 34.

The medium transported in the downward direction from the branching position K1 receives the feeding force from the transport roller pairs 33 and 34 and reaches the inversion roller 39, is curved and inverted by the inversion roller 39, and is fed toward the transport roller pair 31.

In the medium sent to the position opposing the line head 51 again, the second surface opposite to the first surface on which the recording has already been performed opposes the line head 51. This allows recording on the second surface of the medium by the line head 51.

Subsequently, a unit for cooling the head unit 50 will be described. As described above, the intake port 45 is formed at the downstream end of the discharge tray 8 in the medium discharge direction, and air introduced from the intake port 45 is caused to pass through the flow paths Fa, Fb, and Fc, and is discharged from the discharge port 46 as illustrated by the arrow Fd.

Figure 4:
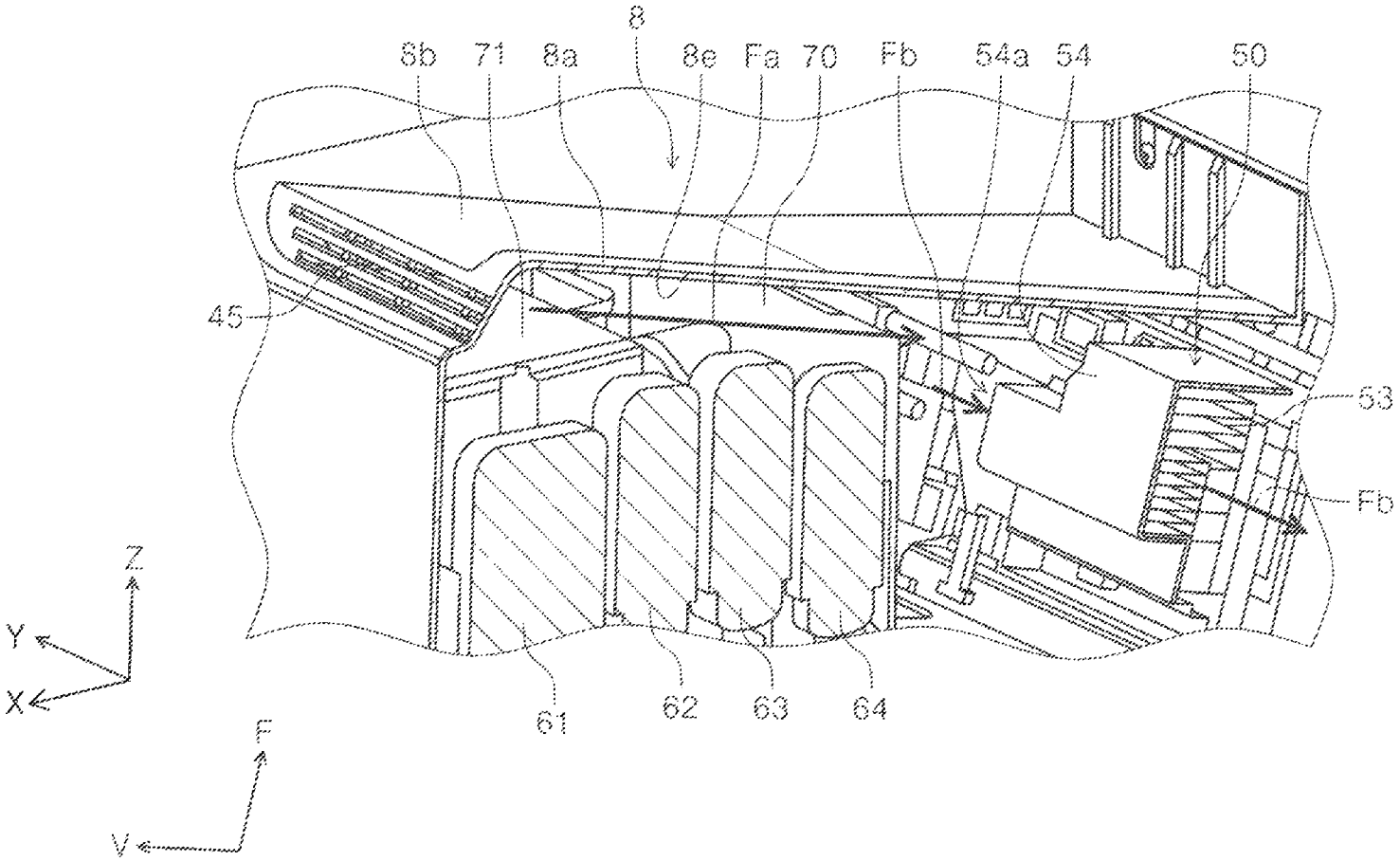
FIG. 4 is a cross-sectional view of a main part of a device.
Figure 7:
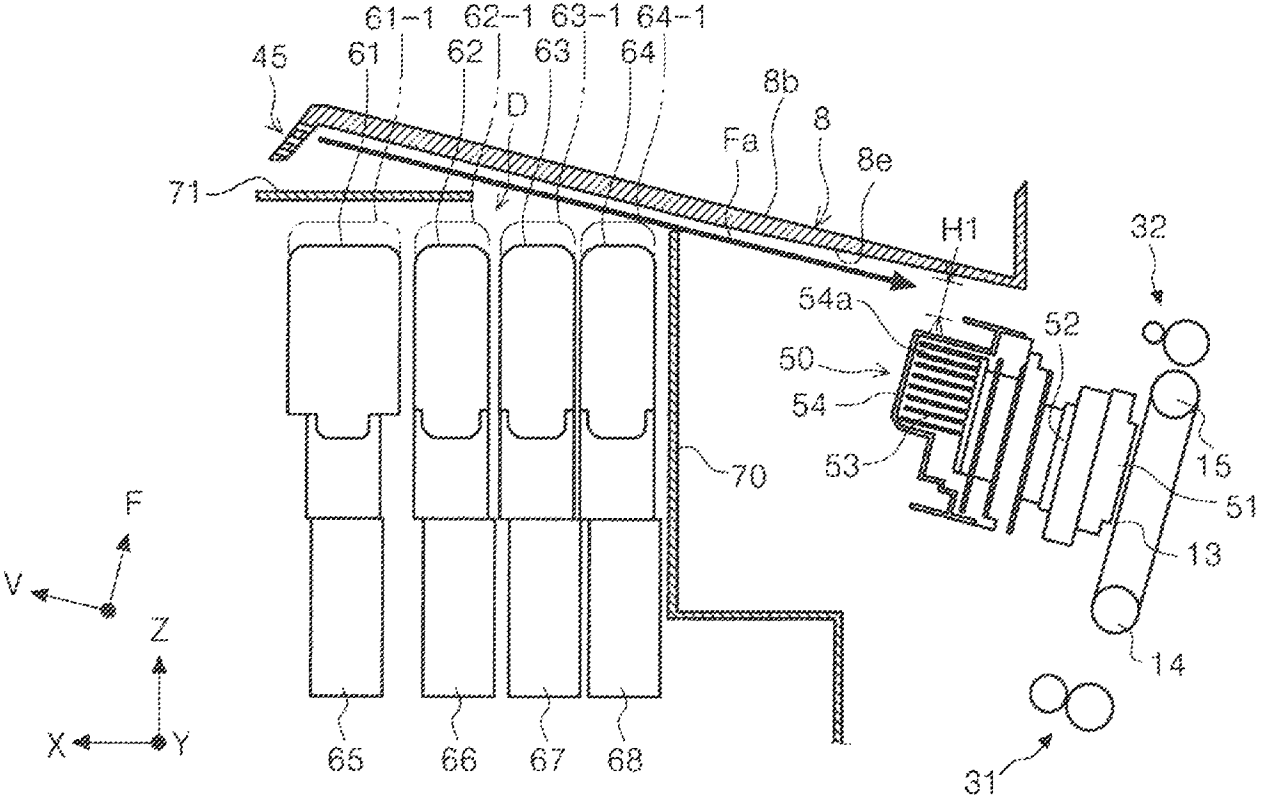
FIG. 7 is an enlarged view of the main part of FIG. 2.

As illustrated in FIGS. 4 and 7, the flow path Fa is a flow path along the lower surface 8*e* of the discharge tray 8.

Figure 5:
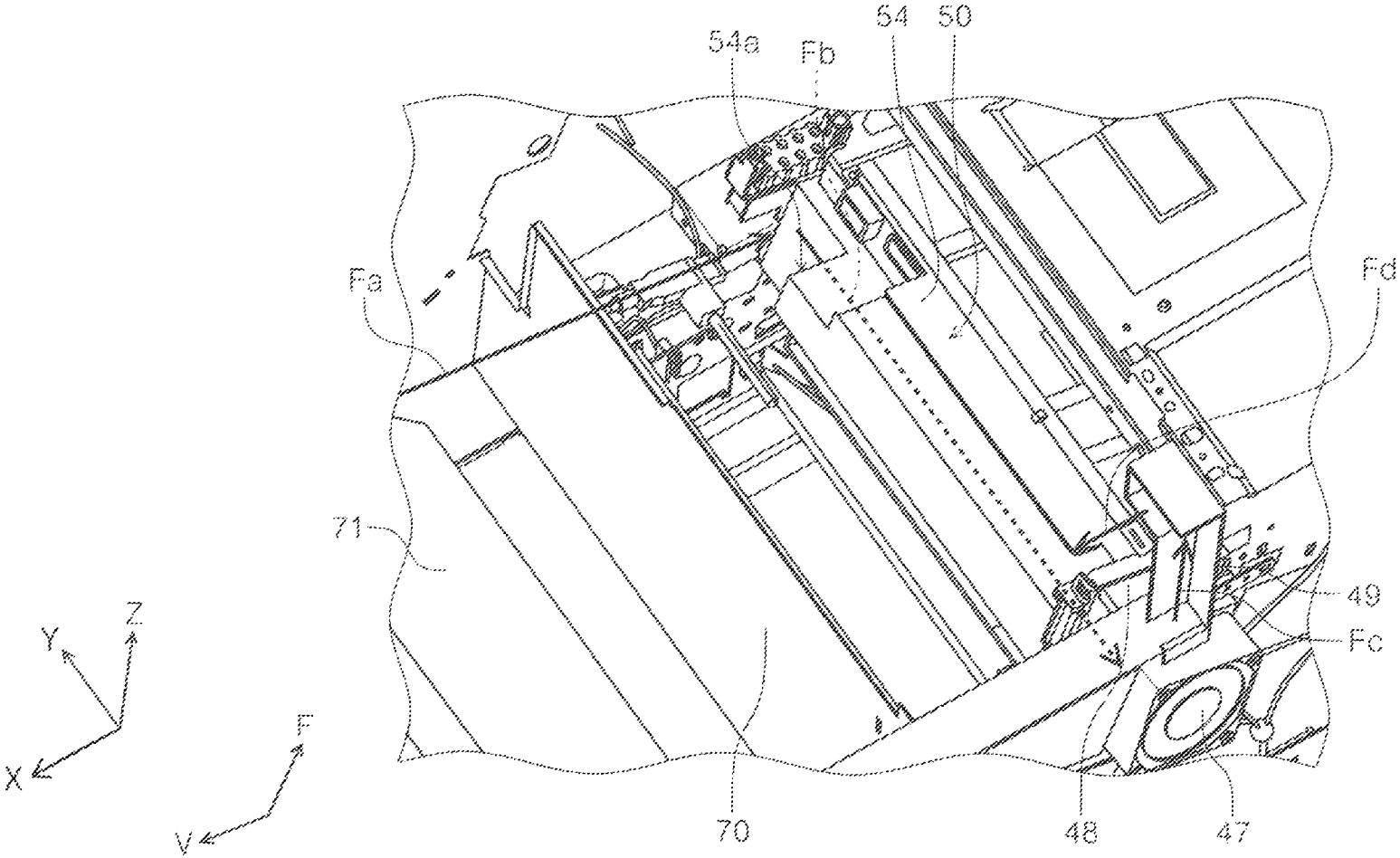
FIG. 5 is a perspective view of the periphery of a head unit.

As illustrated in FIGS. 4 and 5, the flow path Fb is a flow path parallel to the Y-axis direction which passes through the inside of the head unit 50. More specifically, as illustrated in FIG. 7, the head unit 50 includes a head control board 52 in the +V direction with respect to the line head 51, and further includes a heat sink 53 in the +V direction with respect to the head control board 52. The heat sink 53 is an example of a heat dissipation member, and in particular, releases heat generated by the head control board 52, which is a heat generating portion in the head unit 50.

Figure 6:
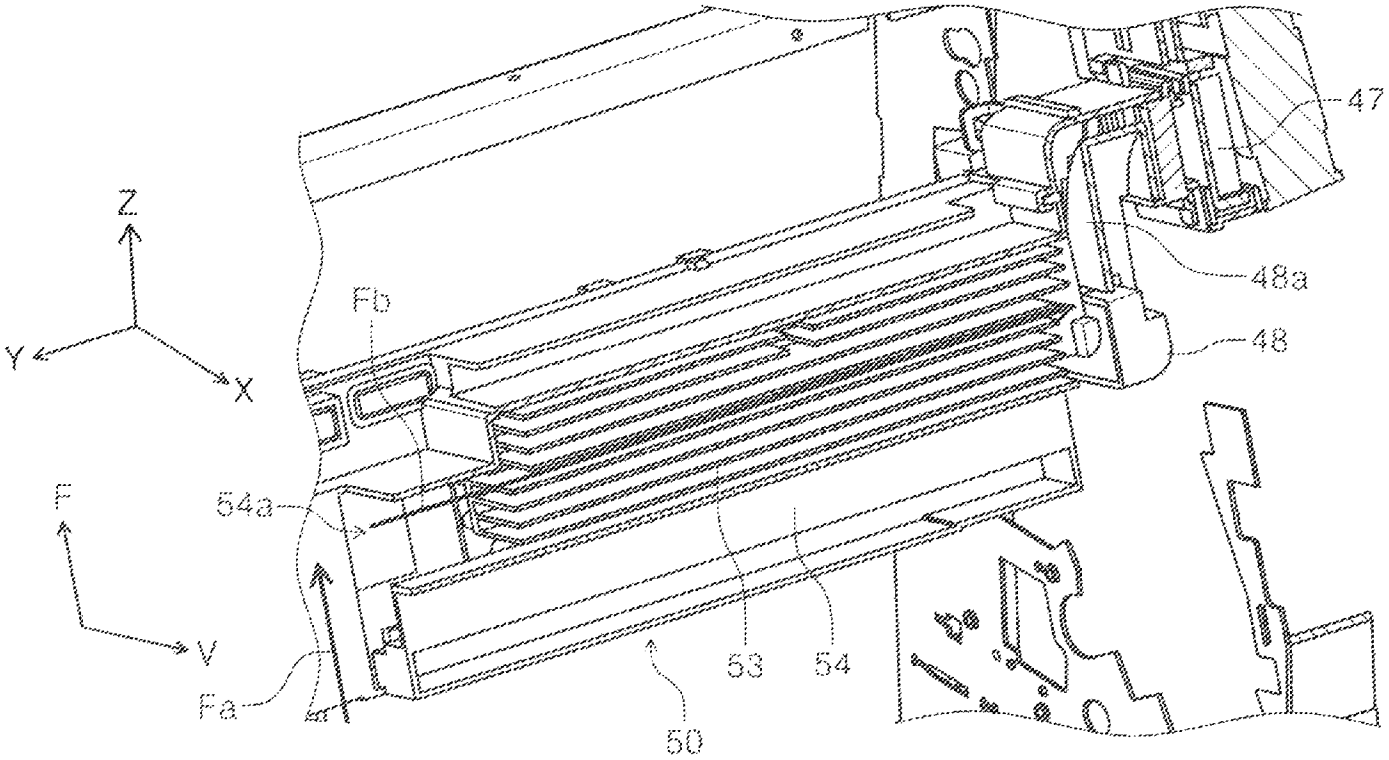
FIG. 6 is a cross-sectional view illustrating the inside of the head unit and an intake guide.

The heat sink 53 has a large number of fins and extends along the Y-axis direction as illustrated in FIG. 6. As illustrated in FIG. 5, the head unit 50 includes a cover member 54 that covers the heat sink 53, and an opening 54*a* for introducing air is formed at an end portion of the cover member 54 in the +Y direction.

The intake guide 48 is provided at an end portion in the −Y direction that is opposite to the +Y direction in which the opening 54*a* is formed, and a suction fan 47 is coupled to a ventilation channel 48*a* formed in the intake guide 48. The suction fan 47 generates a negative pressure inside the ventilation channel 48*a*, and thus inside the head unit 50, so that air is introduced from the intake port 45. Then, the air that has been introduced reaches the opening 54*a* of the head unit 50 through the flow channel Fa, is introduced into the head unit 50 from the opening 54*a*, and reaches the suction fan 47 through the flow path Fb.

A discharge guide 49 is provided above the suction fan 47 as illustrated in FIG. 5, and the air discharged from the suction fan 47 is guided in the +Z direction by the discharge guide 49, and is discharged in a direction of the arrow Fd as illustrated in FIG. 1.

As described above, since the air flow path Fa for cooling the head unit 50, which is an example of the cooling target, is formed along the lower surface 8*e* of the discharge tray 8, it is not necessary to separately ensure a space for air to flow in the horizontal direction inside the device, and as a result, the degree of freedom of the design is improved, and the size of the device in the height direction can also be suppressed.

Note that in the present embodiment, the cooling target is the head unit 50, which is an example of the heat generating portion, but the cooling target is not limited thereto, and other heat generating portions such as a main board and a power supply unit may be the cooling target. Further, the cooling target is not limited to one, and may be a plurality.

Further, in the present embodiment, the flow path of the air for cooling the head unit 50 includes the flow path Fa from the intake port 45 formed at the downstream end of the discharge tray 8 in the medium discharge direction toward the head unit 50 along the lower surface 8*e* of the discharge tray 8.

It is needless to say that the discharge port 46 of the present embodiment may be configured as an intake port and the intake port 45 may be configured as a discharge port, so that the air flow may be opposite to that in the present embodiment.

Figure 3:
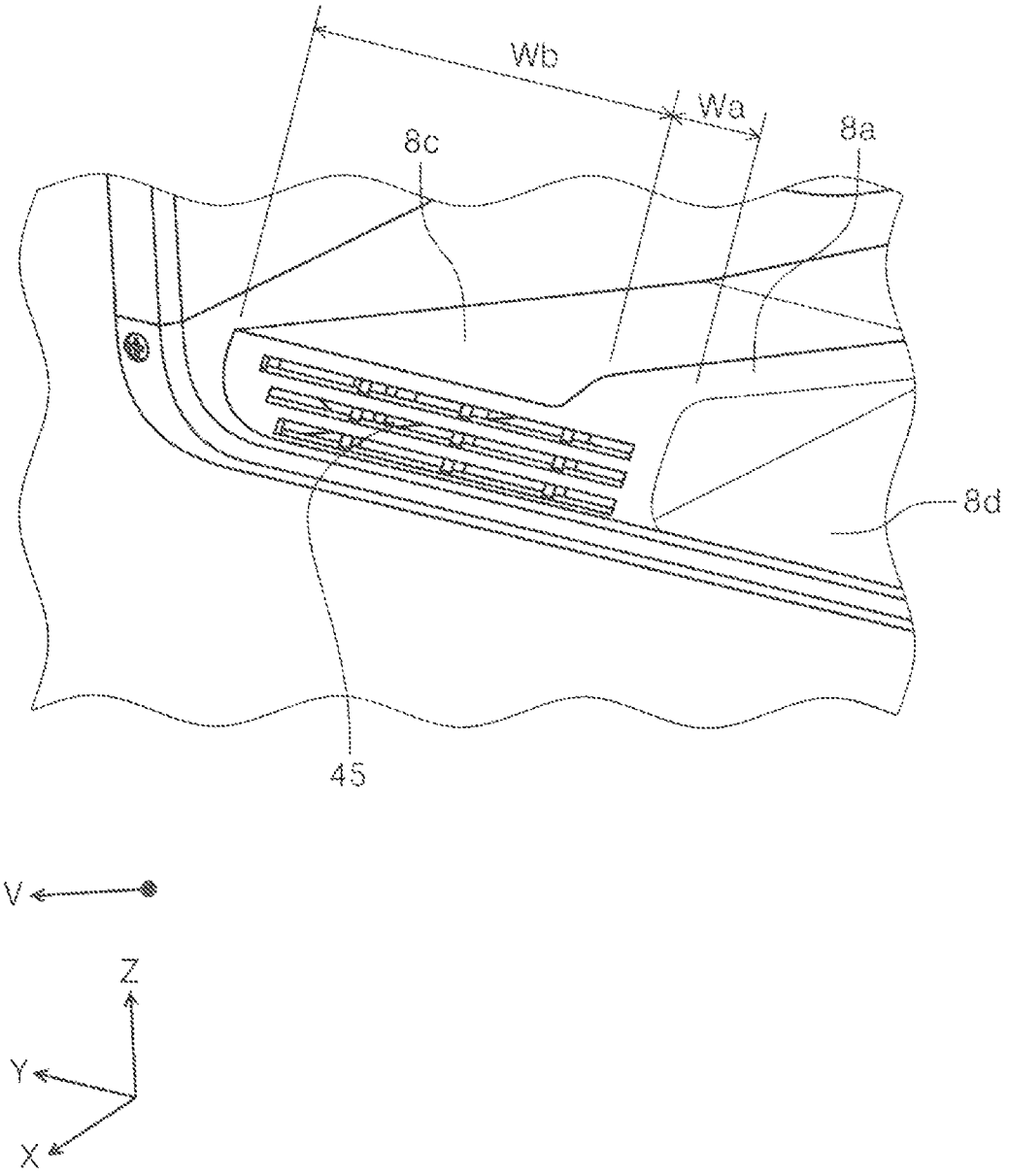
FIG. 3 is an enlarged perspective view of an intake port.

Furthermore, the protruding portion 8*a* protruding upward is formed in the discharge tray 8 along a medium discharge direction, and a portion of the intake port 45 is formed in the protruding portion 8*a*, as illustrated in FIG. 3. As a result, the size of the discharge tray 8 associated with the provision of the intake port 45 can be suppressed, and thus the size of the device can be suppressed. Note that the intake port 45 can also be formed only in a formation range Wa of the protruding portion 8*a*.

Further, the discharge tray 8 includes the first portion 8*c* extending in the +Y direction from the protruding portion 8*a* and the second portion 8*d* extending in the −Y direction from the protruding portion 8*a*. The first portion 8*c* forms a surface higher than the second portion 8*d*, and the intake port 45 extends from the protruding portion 8*a* toward the +Y direction through the first portion 8*c*. That is, the intake port 45 is formed not only in the formation range Wa which uses the protruding portion 8*a* but also in a formation range Wb of the first portion 8*c*. As a result, the intake port 45 can be formed in a wider range, and thus the intake efficiency can be improved.

Further, the air that has passed through the head unit 50 is discharged from the discharge port 46 located above the discharge tray 8 as described with reference to FIG. 1. As a result, the hot air discharged from the discharge port 46 may not be introduced from the intake port 45, and thus an appropriate cooling effect can be obtained.

In addition, since the intake port 45 and the discharge port 46 are provided at positions spaced apart from each other in the horizontal direction, the possibility that the hot air discharged from the discharge port 46 is introduced from the intake port 45 can be further suppressed.

Further, the head unit 50 extends along the Y-axis direction, that is, the medium width direction and includes the heat sink 53 extending along the medium width direction, and the air that has reached the head unit 50 through the flow path Fa is introduced into the head unit 50 and flows in the medium width direction along the heat sink 53 (flow path Fb). This makes it possible to improve the efficiency of heat dissipation from the heat sink 53.

Further, the air that passes through the flow path Fa to the head unit 50 is introduced into the head unit 50 from the opening 54*a*, but at least a portion of the opening 54*a* may be arranged so as to overlap the intake port 45 in the normal direction of the support surface 8*b* of the discharge tray 8 or the F-axis direction. In FIG. 7, a range H1 is a range that overlaps with the intake port 45 in the F-axis direction.

By arranging the opening 54*a* so that at least a portion thereof is included in the range H1, the air introduced from the intake port 45 is directed straight toward the opening 54*a* along the lower side of the discharge tray 8, and thus the intake efficiency of the air from the opening 54*a* is improved.

Further, since the head unit 50 is movably provided toward and away from the medium transport path opposing the line head 51 by moving along the lower surface 8*e* of the discharge tray 8, a space for the head unit 50 to advance and retreat can be suppressed, and thus the size of the device can be suppressed.

Further, since the head unit 50 can be prevented from separating from the flow path Fa in the F-axis direction, the head unit 50 can be efficiently cooled regardless of the position of the head unit 50.

Further, as illustrated in FIG. 7, the ink storage units 61, 62, 63, and 64 for storing ink discharged from the line head 51 are provided below the discharge tray 8, and the flow path Fa faces a housing space D in which the ink storage units 61, 62, 63, and 64 are provided. As a result, a portion of the housing space D can be used as the flow path Fa, and the size of the device can be suppressed.

Further, in FIG. 7, a reference numeral 65 indicates a mounting unit for mounting the ink storage unit 61. Similarly, reference numerals 66, 67, and 68 are mounting units corresponding to the ink storage units 62, 63, and 64, respectively. Each ink storage unit is detachable to a corresponding mounting unit, and is brought into a mounted state by moving in the −Z direction, which is a direction of retracting from the flow path Fa. In FIG. 7, a two-dot chain line indicated by a reference numeral 61-1 illustrates the ink storage unit 61 before moving. Similarly, the two-dot chain line indicated by a reference numeral 62-1 illustrates the ink storage unit 62 before moving, the two-dot chain line indicated by a reference numeral 63-1 illustrates the ink storage unit 63 before moving, and the two-dot chain line indicated by a reference numeral 64-1 illustrates the ink storage unit 64 before moving. By pushing each ink storage unit downward, that is, in the −Z direction, the user can bring the ink storage unit into the mounted state with respect to each mounting unit.

That is, a space for attaching and detaching each ink storage unit is secured above each of the ink storage unit, and since the flow path Fa faces such a space, when each ink storage unit is in the mounted state, the flow path Fa expands in the Z-axis direction. Therefore, the head unit 50 can be cooled more efficiently.

A wall portion 70 for partitioning the housing space D is provided in the −X direction with respect to the housing space D, and a wall portion 71 for partitioning the housing space D is provided in the +Z direction with respect to the housing space D.

Here, since the wall portion 71 extends along the X-axis direction, the wall portion 71 provides a rectifying effect of the air flowing through the flow path Fa.

In addition, since the wall portion 70 is provided extending in the Z-axis direction so as to inhibit the flow channel Fa, a hole may be formed in the wall portion 70 so that the air flowing through the flow channel Fa passes through the wall portion 70 in the −X direction.

The disclosure is not intended to be limited to each embodiment described above, and many variations are possible within the scope of the invention as described in the appended claims. It goes without saying that such variations also fall within the scope of the invention.

What is claimed is:

1. A recording device comprising:

a recording unit configured to perform recording on a medium;

a discharge tray located above the recording unit in a vertical direction of the recording device and configured to support the medium discharged after recording is performed thereon;

an intake port; and a discharge port, wherein a flow path of air for cooling the recording unit is formed between the intake port and the discharge port, at least a portion of the air from the intake port flowing in a space defined between a lower surface of the discharge tray and a liquid storage unit.

2. The recording device according to claim 1, wherein the intake port is located at a downstream end of the discharge tray in a medium discharge direction, the recording unit is located below the discharge tray in the vertical direction, and the flow path extends from the intake port to the recording unit along the lower surface of the discharge tray.

3. The recording device according to claim 2, wherein the discharge tray includes a protruding portion that is formed along the medium discharge direction and protrudes upward and at least a portion of the intake port is formed in the protruding portion.

4. The recording device according to claim 3, wherein the discharge tray includes a first portion extending from the protruding portion toward one end in a width direction that intersects with the medium discharge direction, and a second portion that extends from the protruding portion toward the other end in the width direction, and the intake port extends toward the one end in the width direction through the first portion.

5. The recording device according to claim 2, wherein air that passed through the recording unit is discharged from the discharge port that is located above the discharge tray.

6. The recording device according to claim 5, wherein the intake port and the discharge port are provided at positions spaced apart from each other in a horizontal direction.

7. The recording device according to claim 2, wherein the recording unit extends along a width direction that intersects with the medium discharge direction and includes a heat dissipation member extending along the width direction, and air that reached the recording unit through the flow path is introduced into the recording unit and flows in the width direction along the heat dissipation member.

8. The recording device according to claim 7, wherein:

the recording unit includes an opening that is configured to introduce the air that reached the recording unit through the flow path into the recording unit, wherein at least a portion of the opening overlaps the intake port in a direction along the discharge tray.

9. The recording device according to claim 1, wherein the recording unit is movably provided toward and away from a medium transport path formed at a position opposing the recording unit by moving along the lower surface of the discharge tray.

10. The recording device according to claim 9, further comprising:

a liquid storage unit configured to store liquid to be discharged from the recording unit, wherein the recording unit performs recording on the medium by discharging the liquid from a liquid discharging head configured to discharge the liquid, the flow path is located between the liquid storage unit and the discharge tray in the vertical direction.

11. The recording device according to claim 10, wherein a liquid storage unit overlaps at least a portion of the recording unit in a horizontal direction.

12. The recording device according to claim 10, wherein the liquid storage unit is detachable and is brought into a mounted state by moving in a direction of retracting from the flow path.

* * * * *